US005589137A

United States Patent [19]

Markin et al.

[11] Patent Number: 5,589,137

[45] Date of Patent: Dec. 31, 1996

[54] SPECIMEN CARRIER

[75] Inventors: Rodney S. Markin, Omaha; Michael R. Newcomb, Papillion, both of Nebr.

[73] Assignee: Lab-Interlink, Inc., Omaha, Nebr.

[21] Appl. No.: 418,958

[22] Filed: Apr. 7, 1995

[51] Int. Cl.[6] ..... B01L 9/06

[52] U.S. Cl. ..... 422/104; 422/62; 422/63; 422/64; 422/65; 422/66; 422/102; 206/443; 206/446; 206/456; 206/459.5; 206/569; 211/74

[58] Field of Search ..... 422/62, 63, 64, 422/65, 66, 102, 104; 206/443, 446, 456, 459.5, 569; 211/74

[56] References Cited

U.S. PATENT DOCUMENTS

| | | | |
|---|---|---|---|
| 3,578,412 | 5/1971 | Martin | 23/259 |
| 3,666,082 | 5/1972 | Riggs | 198/130 |
| 3,713,771 | 1/1973 | Taylor et al. | 23/230 R |
| 3,724,654 | 4/1973 | Gerard et al. | 206/459 |
| 3,897,216 | 7/1975 | Jones | 23/259 |
| 3,916,157 | 10/1975 | Roulette et al. | 235/61.12 R |
| 4,022,579 | 5/1977 | Revillet et al. | 23/259 |
| 4,040,533 | 8/1977 | DeBoer et al. | 214/310 |
| 4,218,534 | 8/1980 | LaBelle et al. | 435/5 |
| 4,389,374 | 6/1983 | Sutton et al. | 422/102 |
| 4,454,939 | 6/1984 | Kampf et al. | 198/341 |
| 4,482,522 | 11/1984 | Baudisch et al. | 422/104 |
| 4,510,119 | 4/1985 | Hevey | 422/71 |
| 4,534,465 | 8/1985 | Rothermel et al. | 206/443 |
| 4,727,033 | 2/1988 | Hijikata et al. | 436/69 |
| 4,738,824 | 4/1988 | Takeuchi | 422/63 |
| 4,938,369 | 7/1990 | Carilli | 211/74 |
| 5,011,779 | 4/1991 | Maimon | 435/293 |
| 5,021,218 | 6/1991 | Davis et al. | 422/104 |
| 5,069,336 | 12/1991 | Mauthe | 206/219 |
| 5,098,661 | 3/1992 | Froehlich et al. | 422/102 |
| 5,143,217 | 9/1992 | Igarashi | 206/459.5 |
| 5,148,919 | 9/1992 | Rubin | 206/443 |
| 5,158,895 | 10/1992 | Ashihara et al. | 436/526 |
| 5,186,339 | 2/1993 | Heissler | 211/74 |
| 5,217,694 | 6/1993 | Gibler et al. | 422/104 |
| 5,351,801 | 10/1994 | Markin et al. | 198/346.1 |
| 5,366,062 | 11/1994 | Markin et al. | 198/345.3 |
| 5,366,893 | 11/1994 | Stevens et al. | 435/301 |
| 5,370,215 | 12/1994 | Markin et al. | 198/346.1 |
| 5,372,786 | 12/1994 | Iles | 422/104 |
| 5,375,716 | 12/1994 | Rubin et al. | 206/443 |
| 5,377,813 | 1/1995 | Markin et al. | 198/465.1 |
| 5,402,875 | 4/1995 | Markin et al. | 198/346.1 |
| 5,417,922 | 5/1995 | Markin et al. | 422/65 |
| 5,427,743 | 6/1995 | Markin | 422/104 |
| 5,437,841 | 8/1995 | Balmer | 422/102 |
| 5,452,810 | 9/1995 | Schwartz | 211/74 |

FOREIGN PATENT DOCUMENTS 8300102 1/1983 WIPO .

*Primary Examiner*—Jill Warden
*Assistant Examiner*—Sharidan Carrillo
*Attorney, Agent, or Firm*—Zarley, McKee, Thomte, Voorhees & Sease; Mark D. Frederiksen

[57] ABSTRACT

A specimen carrier is designed for transporting specimen tubes throughout an automatic laboratory conveyance system. The specimen carrier includes a generally rectilinear carrier body with a forward face having an identification zone delimited thereon. An identification code is marked in the identification zone so as to permit mechanical sensing and identification of the carrier on a conveyor system. A plurality of holes of various diameters and depths are provided in the top surface of the carrier to receive specimen tubes of various types. The deepest holes are located centrally, so that the carrier is stable while retaining specimens therein. A groove is formed in the top surface of the carrier body which extends between the specimen tube holes, so as to communicate any fluid spilling from a test tube to the other empty holes in the specimen carrier, thereby retaining the fluid within the body of the carrier. A special vertical slot is provided in one of the vertical holes, utilizing a pair of opposing vertical channels, so as to retain a specimen slide in the specimen carrier.

31 Claims, 3 Drawing Sheets

SPECIMEN CARRIER

TECHNICAL FIELD

The present invention relates generally to apparatus for carrying laboratory specimens, and more particularly to a carrier for transporting test tubes, slides, and other articles with specimens therein.

BACKGROUND OF THE INVENTION

Clinical laboratory testing has changed and improved remarkably over the past 70 years. Initially, tests or assays were performed manually, and generally utilized large quantities of serum, blood or other materials/body fluids. As mechanical technology developed in the industrial work place, similar technology was introduced into the clinical laboratory. With the introduction of new technology, methodologies were also improved in an effort to improve the quality of the results produced by the individual instruments, and to minimize the amount of specimen required to perform each test.

More recently, instruments have been developed to increase the efficiency of testing procedures by reducing turnaround time and decreasing the volumes necessary to perform various assays. Present directions in laboratory testing focus on cost containment procedures and instrumentation. Laboratory automation is one area in which cost containment procedures are currently being explored. Robotic engineering has evolved to such a degree that various types of robots have been applied in the clinical laboratory setting.

The main focus of prior art laboratory automation relies on the implementation of conveyor systems to connect areas of a clinical laboratory. Known conveyor systems in the laboratory setting utilize separate conveyor segments to move specimens from a processing station to a specific laboratory workstation. In order to obtain cost savings, the specimens are sorted manually, and test tubes carrying the specimens are grouped in a carrier rack to be conveyed to a single specific location. In this way, a carrier will move a group of 5–20 specimens from a processing location to a specific workstation for the performance of a single test on each of the specimens within the carrier rack.

With the advent of the inventor's new laboratory automation system as described is in co-pending patent application Ser. No. 07/997,281, entitled "METHOD FOR AUTOMATIC TESTING OF LABORATORY SPECIMENS", the inventor has provided a laboratory automation system which requires a different type of specimen carrier. Because the new laboratory automation system of the co-pending patent application calls for identification and conveyance of an individual patient's specimens throughout the laboratory system, it is no longer feasible to utilize conventional specimen tube carrier racks.

Conventional specimen tube carrier racks suffer several drawbacks when considering use in the inventor's new laboratory automation system. First, prior art carrier racks were designed to hold a single type of specimen tube within a rack. Thus, more than one rack would be required for different sizes and types of specimen tubes.

Also, it was not possible to identify the specimen rack and correlate specific test tubes with an individual rack, for independent conveyance throughout a laboratory system.

While the specimen carrier of applicant's U.S. Pat. No. 5,417,922 solved many of these problems, other drawbacks were yet to be addressed. One unaddressed problem was discovered in actual use, where it was found that the weight of a single large test tube at one end of the carrier would be unstable, and liable to fall over while on the conveyor.

Yet another problem of specimen carriers in general was the potential for leakage of fluid in the event of a cracked or broken test tube within the carrier. Spillage of such fluid could easily contaminate the conveyor system as well as persons coming into contact with the specimen carrier.

In the formation of plastic carriers, it was found difficult to achieve appropriate diameter holes for the test tubes, due to shrinkage during heating and cooling processes. Thus, a test tube would either rattle within a hole or the hole would be too small in diameter to easily accept the desired test tube.

The inventors laboratory automation system also incorporates an identification code printed on a label placed on the front surface of the carrier. It was found that, during use, this label was susceptible to tearing or getting caught in various equipment as the carrier traveled along a conveyor. Thus, the label could potentially be damaged to an extent that it was unreadable, and therefore prevent identification of the specimen in the carrier.

Finally, conventional specimen carriers were not capable of retaining a specimen slide.

SUMMARY OF THE INVENTION

It is therefore a general object of the present invention to provide an improved specimen carrier for use with a laboratory automation system.

Another object of the present invention is to provide a specimen carrier which will receive a wide variety of different, but conventional test tube types, including slides.

Still another object is to provide a specimen carrier with an identification surface permitting automated identification of the carrier on a conveyor system, yet preventing contact with the edges of an imprinted label thereon.

Yet another object is to provide a specimen carrier which is stable, even when holding only a single test tube therein.

Still a further object of the present invention is to provide a specimen carrier which will retain fluids from a leaking test tube in the carrier body.

Still another object is to provide a specimen carrier with the capacity to retain a specimen slide.

These and other objects will be apparent to those skilled in the art.

The specimen carrier of the present invention is designed for transporting conventional specimen tubes throughout an automatic laboratory conveyance system. The specimen carrier includes a generally rectilinear carrier body with forward and rearward faces each having a depression forming identification zone thereon. An identification code is marked on a label in the identification zones so as to permit mechanical sensing and identification of the carrier on a conveyor system. A plurality of holes of various diameters and depths are provided in the top surface of the carrier to receive a conventional test tube or specimen slides of various types. A test tube receptacle includes a plurality of holes overlapping one another, with the deepest holes located centrally, so that the carrier is stable while retaining specimens therein. Because the carrier is designed for use on an automatic laboratory system, one of a variety of types of test tubes must be disposed within the specimen carrier such that the top end of the test tube is located at a predetermined height above the top surface of the carrier. This permits automatic retraction of the specimen tube by other robotic devices. A special vertical slot is provided so as to retain a specimen slide in the specimen carrier.

DESCRIPTION OF THE PREFERRED EMBODIMENTS

Figure 1:
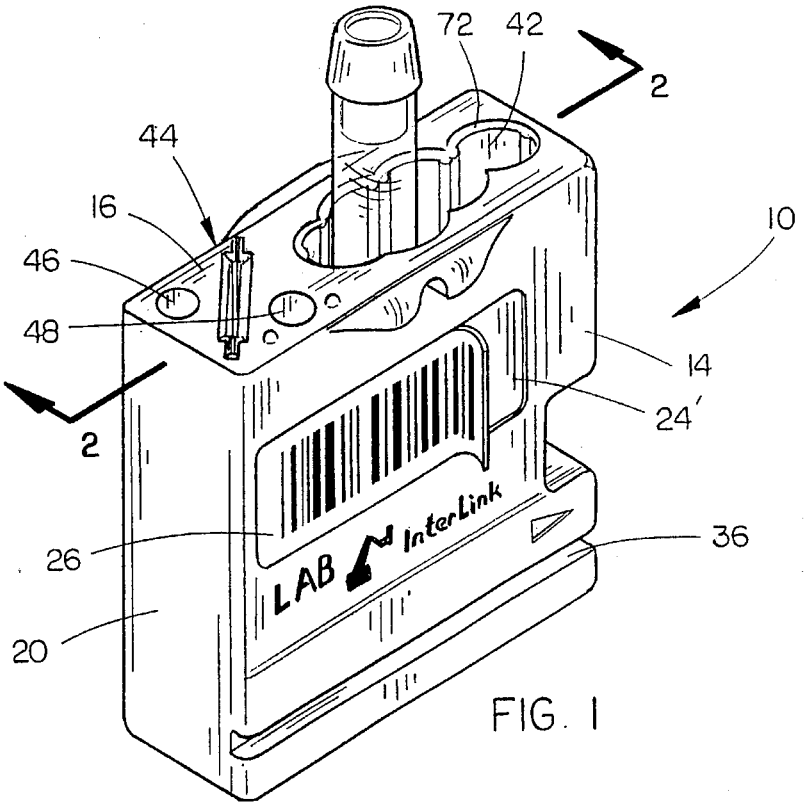
FIG. 1 is a rearward perspective view of the specimen carrier of the present invention.

Referring now to the drawings, in which similar or corresponding parts are identified with the same reference numeral, and more particularly to FIG. 1, the specimen carrier of the present invention is designated generally at 10 and is preferably formed of a solid lightweight block of plastic material.

Referring now to FIGS. 5–9, carrier 10 includes a forward face 12, a rearward face 14, top surface 16, bottom surface 18, and right and left end walls 20 and 22, respectively. Forward face 12 has a generally rectangular depression therein forming an identification zone 24, in which a label 26 (shown in FIG. 1) with identification code, such as bar code, is located.

Figure 3:
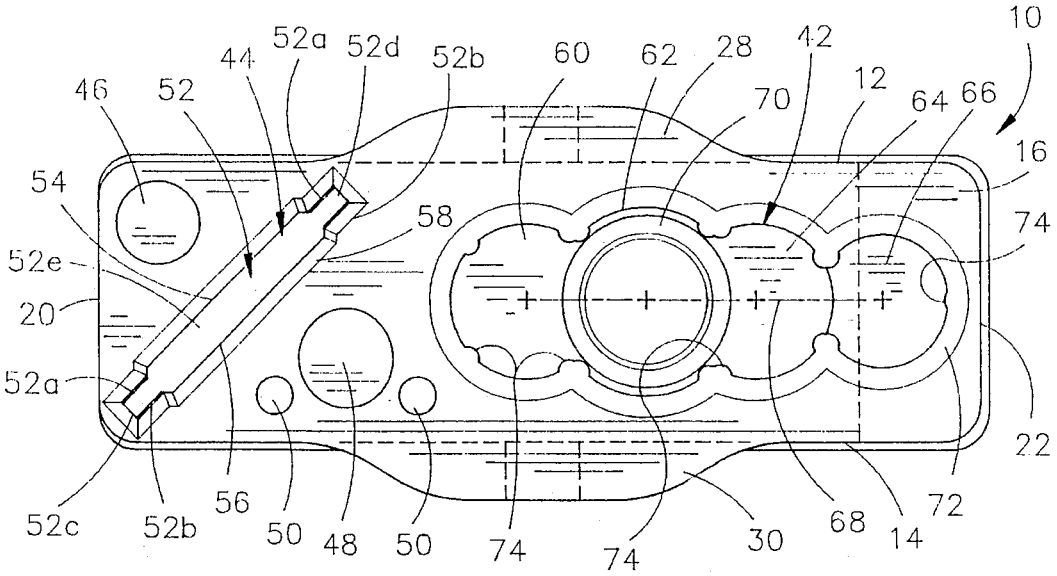
FIG. 3 is an enlarged top plan view of the carrier.
Figure 6:
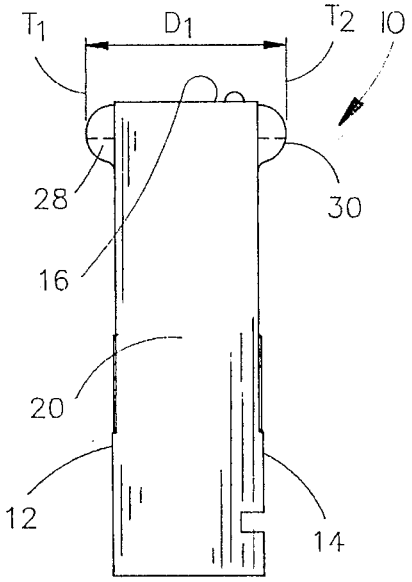
FIG. 6 is an end elevational view taken from the right side of FIG. 5.
Figure 8:
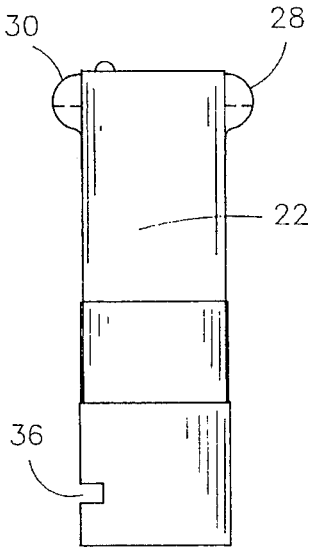
FIG. 8 is an end elevational view from the left end of FIG. 5.
Figure 9:
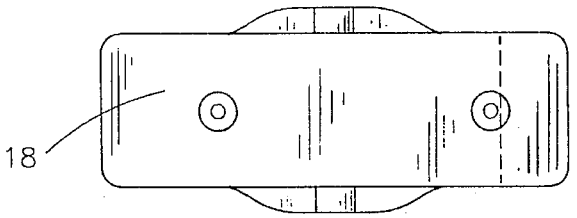
FIG. 9 is a bottom view of the specimen carrier.

A pair of wings 28 and 30 project outwardly from the forward and rearward faces of carrier 10, adjacent the top surface 16. Wings 28 and 30 preferably have a semicircular cross-sectional shape, as shown in FIGS. 6 and 8. Wings 28 and 30 project outwardly from forward and rearward faces 12 and 14 a predetermined distance such that the distance between a tangent T1 of front wing 28, parallel to forward face 12, and a tangent T2 of rear wing 30, parallel to rearward face 14, is a predetermined distance D1. Distance D1 is preferably equal to the diameter of a standard and predefined test tube. In this way, a robotic device, such as a Cartesian robot or a robotic arm, will grasp and carry carrier 10 in the same fashion as grasping and carrying a test tube. As shown in FIG. 3, wings 28 and 30 are centered between end walls 20 and 22, so that carrier 10 is gripped and carried at a central point adjacent the top surface 16. This positioning permits stable movement of the carrier by a robotic arm.

Figure 5:
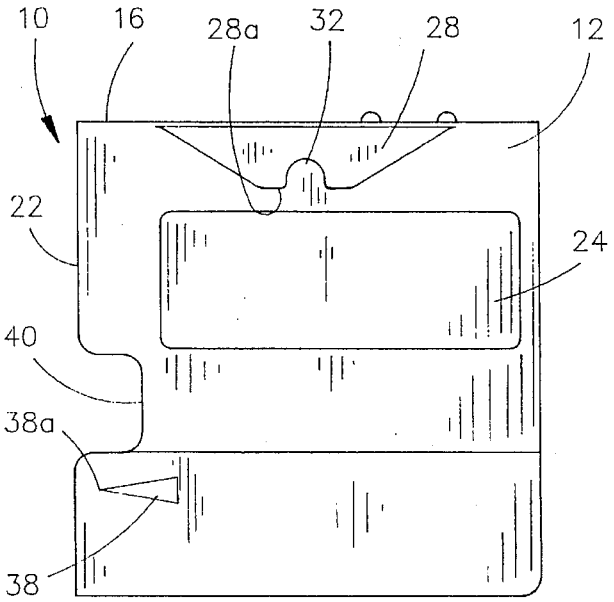
FIG. 5 is a front elevational view.
Figure 7:
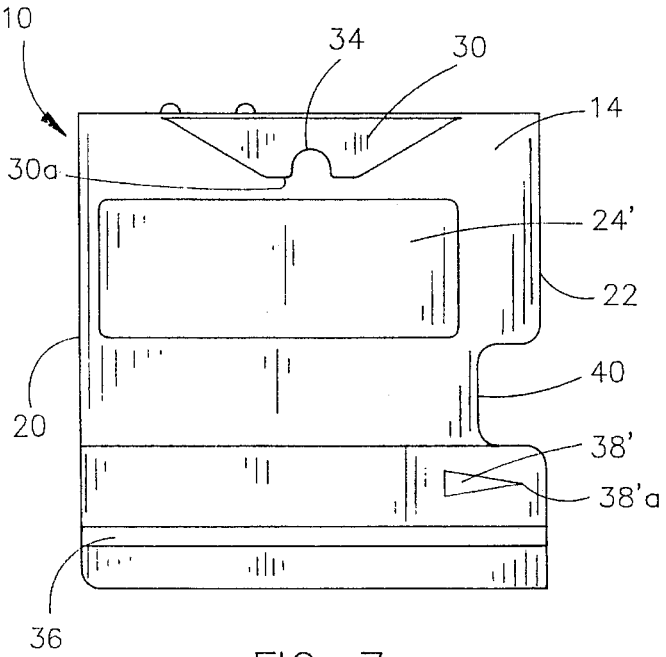
FIG. 7 is a rear elevational view.

Notches 32 and 34 are each formed centrally in the lower surface 28*a* and 30*a* of each wing 28 and 30, as shown in FIGS. 5 and 7. Notches 32 and 34 preferably have a semicircular shape to receive opposingly disposed pins of robotic apparatus for raising and lowering the carrier. As shown in FIGS. 5 and 7, the lower surfaces 28*a* and 30*a* of wings 28 and 30 slope upwardly from notches 32 and 34 towards top surface 16. This sloped surface permits the pins of a robotic apparatus to gently slip off of the carrier 10 if the pins do not engage notches 32 and 34. This prevents carrier 10 from being overturned or jamming in the robotic apparatus if appropriate engagement with the notches does not occur.

A second rectangular depression in the rearward face 14 of carrier 10 (as shown in FIGS. 1 and 7) forms a rearward identification zone 24' in which a label (not shown) with identification code thereon may be located. This permits the location of sensors along a conveyor track on either side of the track to enable detection and recognition of a specimen carrier 10 as it travels along the laboratory automation system. The identification zone depressions 24 and 24' have a depth which will receive the thickness of the label 26, so that no portion of label 26 projects outwardly beyond the forward or rearward face 12 and 14 as the carrier moves along the laboratory automation system. This prevents inadvertent damage to the identification code on the label, or ripping or tearing of the label, during movement.

Identification zones 24 and 24' provide a space for identification code labels, which permit the automated laboratory system to identify the carrier 10 and any specimen contained therein, and route the carrier through the conveyor system as required for conducting tests on specimens within that particular carrier. Because the laboratory automation system typically will utilize a variety of automated equipment, including robotic arms to remove test tubes, slides, or other various specimens from a carrier 10. Such automated equipment requires a standardized and uniform location for the particular specimen to be removed from carrier 10. For this reason, it is preferred that all specimen carriers 10 be oriented on a conveyor track in the same orientation.

Two separate structural features are provided in order to accomplish this goal. First, rearward face 14 of carrier 10 is provided with a groove 36, as shown in FIGS. 1 and 7, which extends horizontally across the entire rearward face from end wall 20 to end wall 22. Groove 36 corresponds with a projecting pin mounted on a rear guide rail support at the workstations of the laboratory automation system. After testing of a specimen has been completed, carrier 10 is inserted on a conveyor track and must move past the pin in order to continue along the conveyor system. If carrier 10 is oriented correctly, groove 36 will permit carrier 10 to move past this pin. However, if carrier 10 is reversed, the pin will contact the end wall 20 and prevent movement of carrier 10 along the conveyor track.

A second structural feature for indicating appropriate direction of carrier 10 is a triangular depression 38 formed in the forward face 12, and a triangular depression 38' formed in the rearward face 14 of carrier 10, with the apex 38*a* and 38'*a* of the triangle "pointing" in the direction in which the carrier 10 should travel on the conveyor track. Thus, a technician may visually determine the appropriate orientation of carrier 10 by viewing triangular depressions 38 or 38'.

A generally rectangular notch 40 is formed in left end wall 22 of carrier 10, as shown in FIGS. 5 and 7. Notch 40 is located so as to receive an extendable arm therethrough as the carrier 10 travels along a conveyor track. Because several carriers 10 may be queued at a gate at a particular workstation, the laboratory automation system permits individual carriers to proceed by extending an arm into a notch 40 in the line of carriers, to prevent subsequent carriers from continuing travel along the conveyor track.

Referring once again to FIG. 1, carrier 10 includes a variety of openings formed in the top surface 16 for receiving specimens in various types of containers or slides. These openings include a test tube receptacle, designated generally at 42, a slide receptacle designated generally at 44, and first and second wells 46 and 48. As shown in the drawings, test tube receptacle 42 is located generally centrally between forward and rearward faces 12 and 14, and extends generally from the center of the top surface to adjacent left end wall 22. The right end of the top surface 16 includes wells 46 and 48 located on opposing sides of slide receptacle 44.

Referring now to FIG. 3, first and second wells 46 and 48 preferably have the same depth, and are generally cylindrical in shape, with a predetermined diameter to receive standard specimen container tubes therein. A pair of "bumps" 50 are provided on upper surface 16 adjacent second well 48, to support a flared upper end of a tube inserted within well 48, spaced above top surface 16 of carrier 10.

Slide receptacle 44 has a generally rectangular opening, and a depth less than the length of a conventional specimen slide, such that a slide will project upwardly from the top surface 16 of carrier 10 when inserted therein. As shown in FIG. 3, rectangular hole 52 includes opposing forward and rearward vertical walls 52*a* and 52*b* and opposing vertical end walls 52*c* and 52*d*, and a bottom 52*e*. A shallow channel 54 is formed in forward wall 52*a* and extends the entire depth of receptacle 44 but less than the width of forward wall 52*a*, as measured between end walls 52*c* and 52*d*. In this way, channel 54 will receive the thickness of a slip cover and specimen on the forward surface of a slide. Similarly, a rearward channel 56 is formed in rearward receptacle wall 52*b*, which extends less than the full width of rearward wall 52*b*, to receive a cover slip and specimen on a slide positioned within receptacle 44. The narrower distance between forward and rearward walls 52*a* and 52*b* at the end walls 52*c* and 52*d* maintains a slide in a vertical orientation, and prevents "rattling" of the slide within receptacle 44, thereby preventing contact of a slip cover with a wall of the receptacle. A bevel 58 is formed along the entire perimeter of hole 52 at the juncture between top surface 16 with the hole vertical walls, to assist in guiding a slide within the receptacle 44.

Figure 2:
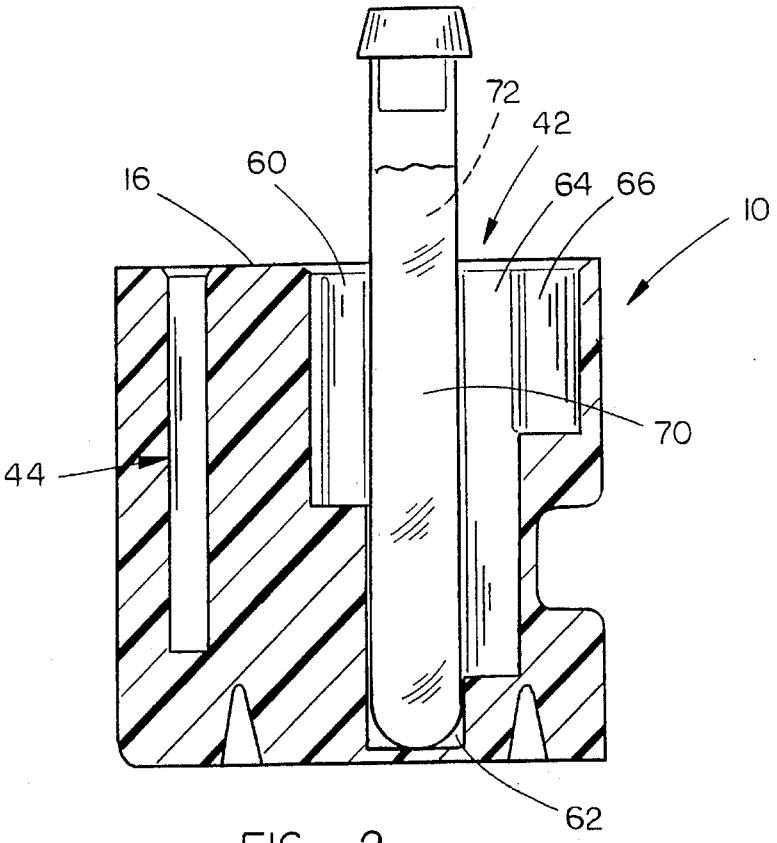
FIG. 2 is a sectional view taken at lines 2—2 in FIG. 1.

Test tube receptacle 42 consists of four overlapping holes 60, 62, 64, and 66, which extend downwardly from top surface 16 to form a large enclosed cavity within the body of carrier 10. As shown in FIGS. 2 and 3, fourth hole 66 has the smallest diameter and shallowest depth. First hole 60 has a slightly greater depth and a slightly greater diameter than fourth hole 66. Third hole 64 has a diameter substantially the same as first hole 60, but a greater depth. Finally, second hole 62 has the largest diameter and greatest depth.

As shown in FIG. 3, the centers of holes 60-66 are aligned along a center line 68 which is centered between forward and rearward faces 12 and 14 of carrier 10. The largest and deepest hole 62 is located proximal the center of top surface 16, with the smallest diameter and shallowest hole 66 located closest to left end wall 22. This orientation of holes 60–66 stabilizes the specimen carrier, since only a single test tube is normally inserted therein. Holes 60–66 are located with centers of adjacent holes separated by a distance less than the diameter of the larger of the two holes, such that the holes "overlap" and open into one another.

Figure 4:
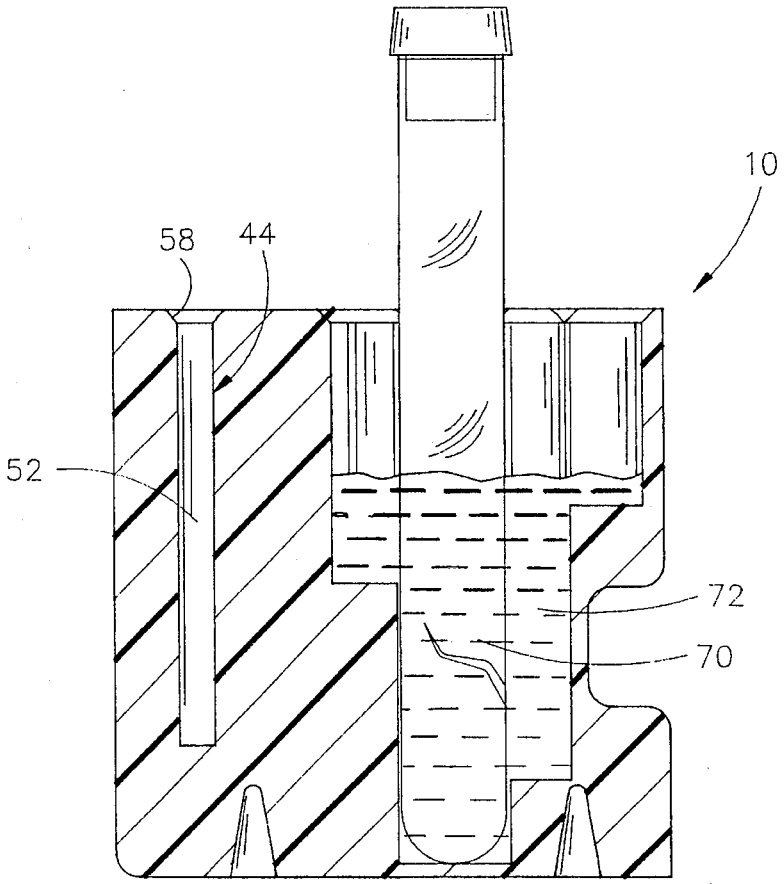
FIG. 4 is a sectional view similar to FIG. 2, but showing a cracked test tube therein.

FIG. 2 shows a test tube 70 filled with a liquid specimen 72 to a level above the top surface 16 of carrier 10, when test tube 70 is inserted within test tube receptacle 42. In the event of a crack or leak in the test tube 70, as shown in FIG. 4, the contents of the test tube flow into the adjoining holes 60, 64 and 66 of test tube receptacle 42, so as to retain all fluid within the confines of the carrier body 10. Obviously, a single cylindrical hole with a diameter only slightly larger than the test tube would not be capable of retaining the entire contents of a test tube within the confines of the carrier body.

As shown in FIGS. 1 and 3, the entire perimeter of the junction of test tube receptacle 42 with top surface 16 has a bevel 72 formed thereon. Bevel 72 permits easy insertion of test tubes within any of the test tube holes 60–66, and also serves to direct fluid leaking from an upper end of a test tube downwardly into the test tube receptacle 42.

In addition, a plurality of vertically disposed, projecting ridges are formed in each hole 60, 62, 64 and 66, and spaced around the perimeter of each hole. These ridges 74 have a three-fold purpose. First, they are located along the vertical juncture edges of each pair of adjacent holes to prevent a test tube within one hole from easily tipping and sliding into an adjacent hole. In addition, ridges 74 serve to hold a test tube 70 spaced slightly away from the walls forming the hole for that test tube. In this way, leaking fluid is more readily received and retained within the test tube receptacle 42. Finally, the ridges in each hole form the diameter for receiving a test tube. Thus, even if the actual diameter does not precisely match a test tube, the tube will be frictionally engaged along the ridges. A hole without such ridges was found to either permit rattling of a tube therein, or require excessive pressure to insert and remove test tubes.

The diameters and depths of holes 60–66 and wells 46 and 48 are determined for specific types of specimen tubes commonly utilized in the medical field. The varying depths of the holes and wells are necessary in order to maintain a standard height of the top of a test tube above the top surface 16 of carrier 10. This standard height is particularly critical in automated laboratory systems because the automated functions of various equipment am based upon this standard dimension. For example, a robotic arm, or other robotic apparatus, utilized to remove a test tube from Carrier 10 would be programmed to grip a test tube at a particular location within carrier 10, and to grip that portion of the test tube which projects upwardly from top surface 16. If the upper end of the test tube is not within the predetermined dimension, a robotic device could easily break the test tube or incorrectly align a test tube within a scientific instrument.

Whereas the invention has been shown and described in connection with the preferred embodiment thereof, it will be understood that many modifications, substitutions and additions may be made which are within the intended broad scope of the appended claims. For example, the number and size of holes within the specimen carrier is determined only by the variety of the specimen tube types that are desired to be utilized in the laboratory automation system. Similarly, while a conventional bar code is shown for the identification code, various other types of identification code materials could be utilized in printed format or otherwise.

I claim:

1. A specimen carrier for transporting a laboratory specimen carried within a specimen tube or on a specimen slide, comprising:

a carrier body having a forward face and opposing rearward face, a top surface and opposing bottom surface, a right end wall and opposing left end wall an aperture having alternating curved portions forming a plurality of vertical cylindrical holes for receiving specimen tubes of varying diameter and depth dimensions, said aperture comprising;

a first vertical cylindrical hole formed in the top surface of the carrier body, said hole having a first diameter and depth dimensions so as to receive a first specimen tube partially therein; and a second vertical cylindrical hole formed in the top surface of the carrier body said second hole having a second diameter and depth dimensions different from said first hole so as to receive a second specimen tube having diameter and depth dimensions different from said first tube; said second hole, overlapping the first hole to form a single cavity, wherein said cavity extends vertically from the lower end to an open upper end at the top surface of the carrier body and extends horizontally to include the diameter of each of said first and second holes, to retain fluid therein.

2. The specimen carrier of claim 1, wherein said first and second holes have centers along a center line between the carrier body forward and rearward faces.

3. The specimen carrier of claim 1, further comprising a rectangular hole extending vertically downward from the carrier body top surface and having a predetermined width, length and depth so as to receive a specimen slide in a vertical orientation, said rectangular hole spaced from said first and second holes.

4. The specimen carrier of claim 3, wherein said rectangular hole includes vertical forward and rearward opposing walls, opposing vertical end walls, and a bottom, and further comprising a shallow depression formed in the forward wall extending downwardly from the top surface and extending less than the full length of the forward wall from end wall to end wall.

5. The specimen carrier of claim 4, wherein said rectangular hole further includes a shallow depression formed in the rearward wall extending downwardly from the top surface and extending less than the full length of the rearward wall from end wall to end wall.

6. The specimen carrier of claim 1, further comprising a cylindrical well formed in the carrier body top surface, spaced from said first and second holes.

7. The specimen carrier of claim 6, further comprising a first upwardly projecting bump formed on the carrier body top surface, proximal the well, located to contact a projecting rim of a specimen tube cap on a specimen tube inserted in the well.

8. The specimen carrier of claim 1, further comprising:

a depression formed in the forward face, spaced from the top surface, bottom surface, and end walls; and a label mounted within said depression, having identification indicia thereon relating to a specimen associated with the carrier;

said depression having a depth such that the label does not project outwardly beyond the carrier body forward face.

9. The specimen carrier of claim 8, comprising:

a depression formed in the rearward face, spaced from the top surface, bottom surface, and end walls; and a label mounted within said rearward face depression, having identification indicia thereon relating to a specimen associated with the carrier;

said rearward face depression having a depth such that the label does not project outwardly beyond the carrier body rearward face.

10. The specimen carrier of claim 1, further comprising:

a first wing projecting forwardly from the forward face, proximal the top surface and extending less than the length of the carrier body, as measured from end wall to end wall; and a second wing projecting rearwardly from the rearward face, opposite said first wing and having a length equal to the first wing.

11. The specimen carrier of claim 10, wherein each said wing has a semicircular shape in vertical cross-section taken through a center of the carrier body orthogonal to the forward and rearward faces.

12. The specimen carrier of claim 1, wherein said first hole includes a vertical side wall extending partially therearound, wherein said second hole includes a vertical side wall extending partially therearound and joining the first hole side wall along a vertical juncture, and further comprising:

a first plurality of spaced-apart ridges extending vertically along said first hole side wall; and a second plurality of spaced-apart ridges extending vertically along said second hole side wall.

13. The specimen carrier of claim 12, wherein said ridges project radially inwardly from the hole side walls and extend continuously from the hole bottom to the carrier body top surface.

14. The specimen carrier of claim 3, further comprising a generally cylindrical well formed in the carrier body top surface, spaced from said first and second holes.

15. The specimen carrier of claim 14, further comprising a first upwardly projecting bump formed on the carrier body top surface, proximal the well, located to contact a projecting rim of a specimen tube cap on a specimen tube inserted in the well.

16. The specimen carrier of claim 3, further comprising:

a depression formed in the forward face, spaced from the top surface, bottom surface, and end walls; and a label mounted within said depression, having identification indicia thereon relating to a specimen associated with the carrier;

said depression having a depth such that the label does not project outwardly beyond the carrier body forward face.

17. The specimen carrier of claim 16, comprising:

a depression formed in the rearward face, spaced from the top surface, bottom surface, and end walls; and a label mounted within said rearward face depression, having identification indicia thereon relating to a specimen associated with the carrier face depression having a depth such that the label does not project outwardly beyond the carrier body rearward face.

18. The specimen carrier of claim 3, further comprising:

a first wing projecting forwardly from the forward face, proximal the top surface and extending less than the length of the carrier body, as measured from end wall to end wall; and a second wing projecting rearwardly from the rearward face, opposite said first wing and having a length equal to the first wing.

19. The specimen carrier of claim 18, wherein each said wing has a semicircular shape in vertical cross-section taken through a center of the carrier body orthogonal to the forward and rearward faces.

20. The specimen carrier of claim 3, wherein said first hole includes a vertical side wall extending partially therearound, wherein said second hole includes a vertical side wall extending partially therearound and joining the first hole side wall along a vertical juncture, and further comprising:

a first plurality of spaced-apart ridges extending vertically along said first hole side wall; and a second plurality of spaced-apart ridges extending vertically along said second hole side wall.

21. The specimen carrier of claim 20, wherein said ridges project radially inwardly from the hole side walls and extend continuously from the hole bottom to the carrier body top surface.

22. The specimen carrier of claim 8 further comprising:

a first wing projecting forwardly from the forward face, proximal the top surface and extending less than the length of the carrier body, as measured from end wall to end wall; and a second wing projecting rearwardly from the rearward face, opposite said first wing and having a length equal to the first wing.

23. The specimen carrier of claim 22, wherein each said wing has a semicircular shape in vertical cross-section taken through a center of the carrier body orthogonal to the forward and rearward faces.

24. The specimen carrier of claim 16, further comprising:

a first wing projecting forwardly from the forward face, proximal the top surface and extending less than the length of the carrier body, as measured from end wall to end wall; and a second wing projecting rearwardly from the rearward face, opposite said first wing and having a length equal to the first wing.

25. The specimen carrier of claim 24, wherein each said wing has a semicircular shape in vertical cross-section taken through a center of the carrier body orthogonal to the forward and rearward faces.

26. A specimen carrier of claim 1, further comprising:

a rectangular hole extending vertically downward from the carrier body top surface and having a predetermined width, length and depth so as to receive a specimen slide in a vertical orientation;

said rectangular hole including vertical forward and rearward walls, opposing vertical end walls, and a bottom;

said rectangular hole forward wall having a flat shallow depression formed therein extending from the top surface to the bottom of the rectangular hole, and extending less than the full length of the forward wall as measured from end wall to end wall;

said depression forming a flat vertical wall parallel to the rectangular hole forward and rearward walls.

27. The specimen carrier of claim 26, wherein said rectangular hole further includes a shallow depression formed in the rearward wall extending downwardly from the top surface and extending less than the full length of the rearward wall from end wall to end wall.

28. The specimen carrier of claim 27, further comprising:

a depression formed in the forward face, spaced from the top surface, bottom surface, and end walls; and a label mounted within said depression, having identification indicia thereon relating to a specimen associated with the carrier;

said depression having a depth such that the label does not project outwardly beyond the carrier body forward face.

29. The specimen carrier of claim 28, further comprising:

a first wing projecting forwardly from the forward face, proximal the top surface and extending less than the length of the carrier body, as measured from end wall to end wall; and a second wing projecting rearwardly from the rearward face, opposite said first wing and having a length equal to the first wing.

30. The specimen carrier of claim 29, wherein each said wing has a semicircular shape in vertical cross-section taken through a center of the carrier body orthogonal to the forward and rearward faces.

31. A specimen carrier of claim 1, further comprising:

a first wing projecting forwardly from the forward face, proximal the top surface;

a second wing projecting rearwardly from the rearward face, opposite said first wing;

said wings each including a bottom surface of carrier body with a portion orthogonal to the forward and rearward faces, each said wing having a notch formed in the bottom surface extending upwardly and perpendicularly to the forward and rearward faces;

said wing bottom surfaces sloping upwardly from said notches to the ends of the wings towards the carrier top surface.

* * * * *